US006729852B2

(12) United States Patent
Schnatterer

(10) Patent No.: US 6,729,852 B2
(45) Date of Patent: May 4, 2004

(54) VACUUM PRODUCING DEVICE

(75) Inventor: Jürgen Schnatterer, Wolfschlugen (DE)

(73) Assignee: Festo AG & Co., Esslingen (DE)

( * ) Notice: Subject to any disclaimer, the term of this patent is extended or adjusted under 35 U.S.C. 154(b) by 119 days.

(21) Appl. No.: 10/049,739

(22) PCT Filed: Jun. 11, 2001

(86) PCT No.: PCT/EP01/06563

§ 371 (c)(1),
(2), (4) Date: Feb. 15, 2002

(87) PCT Pub. No.: WO02/04818

PCT Pub. Date: Jan. 17, 2002

(65) Prior Publication Data

US 2002/0114705 A1 Aug. 22, 2002

(30) Foreign Application Priority Data

Jul. 7, 2000 (DE) ..... 200 11 839 U

(51) Int. Cl.[7] ..... F04F 5/48
(52) U.S. Cl. ..... 417/189; 417/182; 417/151
(58) Field of Search ..... 417/189, 182, 417/184, 187, 151, 174, 198, 190, 191, 170, 176, 179; 137/832

(56) References Cited

U.S. PATENT DOCUMENTS

| | | | | |
|---|---|---|---|---|
| 4,073,602 A | | 2/1978 | Cagle | 417/185 |
| 4,402,651 A | | 9/1983 | Ise | 417/182 |
| 4,466,778 A | | 8/1984 | Volkmann | 417/174 |
| 4,549,854 A | * | 10/1985 | Yamamoto | 417/187 |
| 4,759,691 A | * | 7/1988 | Kroupa | 417/174 |
| 4,865,521 A | * | 9/1989 | Ise et al. | 417/187 |
| 6,155,796 A | * | 12/2000 | Schmalz et al. | 417/187 |
| 6,171,068 B1 | * | 1/2001 | Greenberg | 417/174 |

FOREIGN PATENT DOCUMENTS

| | | |
|---|---|---|
| DE | 38183381 A1 | 12/1988 |
| DE | 19512700 A1 | 10/1996 |
| DE | 29903330 U1 | 8/1999 |
| DE | 19812275 A1 | 9/1999 |

* cited by examiner

*Primary Examiner*—Justine R. Yu
*Assistant Examiner*—Han L Liu
(74) *Attorney, Agent, or Firm*—Hoffmann & Baron, LLP

(57) ABSTRACT

A vacuum producing means having a housing (2) with an inlet connection (4) and a suction connection (6) arranged opposite to same. The housing (2) comprises a suction nozzle means (16) and a gage pressure pulse means (35) arranged alongside same with the same alignment, for producing a fluid gage pressure pulse to be delivered into the suction space. The gage pressure pulse means (35) comprises a switching valve (35) combined with a pressure plenum (37), the valve member of the switching valve being so driven in a manner dependent of the differential thereat that the pressure plenum is either connected fluidwise with the inlet connection (4) or with the suction connection (6).

18 Claims, 2 Drawing Sheets

VACUUM PRODUCING DEVICE

FIELD OF THE INVENTION

The invention relates to a vacuum producing device for operation on the so-called ejector principle and adapted to serve to produce vacuum in the space defined by a vacuum plate or suction cup for materials handling and to systematically cut such vacuum when required using a gage pressure pulse.

BACKGROUND OF THE INVENTION

A vacuum producing device disclosed in the German utility model 29,903,330 comprises a housing with inlet and suction connections arranged on oppositely placed inlet and suction sides, a suction nozzle means being accommodated in the housing between the connections and being aligned in the transverse direction, such suction connection nozzle being able to produce a suction effect at the suction connection. During suction operation a pressure plenum is charged, which is able to produce a gage pressure pulse for introducing air into the suction space, a valve arranged in an extension of the suction nozzle means being employed for control of the gage pressure pulse, such valve being designed as a component of an air economizing means. Said known device is relatively bulky.

SUMMARY OF THE INVENTION

One object of the present invention is to provide a vacuum producing device, which may be manufactured with substantially smaller dimensions in order to favor installation in situations where space is at a premium.

A vacuum producing device disclosed in the German utility model 29,903,330 comprises a housing with inlet and suction connections arranged on oppositely placed inlet and suction sides, a suction nozzle means being accommodated in the housing between the connections and being aligned in the transverse direction, such suction nozzle being able to produce a suction effect at the suction connection. During suction operation a pressure plenum is charged, which is able to produce a gage pressure pulse for introducing air into the suction space, a valve arranged in an extension of the suction nozzle means being employed for control of the gage pressure pulse, such valve being designed as a component of an air economizing means.

Said known device is relatively bulky. Accordingly one object of the present invention is to provide a vacuum producing device, which may be manufactured with substantially smaller dimensions in order to favor installation in situations where space is at a premium.

In order to attain this object a vacuum producing device is provided comprising a housing, which on an inlet side has an inlet connection for supplying a fluid pressure medium and, on a suction side opposite to the inlet side, a suction connection which is connected or fluid pressure medium and, on a suction side opposite to the inlet side, a suction connection which is connected or able to be connected with the suction space, an elongated suction nozzle means arranged in the housing and extending in the same direction as an imaginary linear connecting line running between the inlet connection and the suction connection, an inflow opening, which is aligned like the inlet connection, of such suction nozzle means being connected with the inlet connection and a suction opening of said suction nozzle means being connected with the suction connection, and the outflow opening of said suction nozzle means being connected with an outlet, such outlet being located on an outlet side, of said housing, aligned athwart the imaginary connecting line and also athwart the longitudinal extent of the suction nozzle means, and an elongated gage pressure pulse means arranged in the housing alongside and adjacent to the suction nozzle means with the same alignment as same, such gage pressure means serving for producing a fluid gage pressure pulse for the suction space, such gage pressure means having a switching valve combined with a pressure plenum, said valve having a first valve opening connected with the inlet connection and a second valve opening connected with the suction side, said valve having a valve member being arranged to be so operated in a manner dependent on a pressure differential applied to it that the pressure plenum is connected either with the first or with the second valve opening for the passage of fluid.

It is in this manner that a vacuum producing device can be provided possessing an extremely slim, compact configuration. The inlet connection and the suction connection are arranged opposite to one another on mutually opposite sides of the housing, the suction nozzle means and the gage pressure pulse means being arranged longitudinally alongside each other in the housing with the same alignment as an imaginary connecting line joining the inlet connection and the suction connection. Since the correspondingly placed gage pressure pulse means also contains the pressure plenum, it is possible to do without external pressure plenum means and all component are collected together in a minimum space. In connection with the generally linear design of the vacuum producing device there is as a result a high degree of efficiency as well with a small number of points at which flow is redirected. All in all the vacuum producing device is characterized by a rapid pressure decay time if necessary in the suction space, since the gage pressure being established in the pressure plenum can cause an automatic switching of the switching valve when there is an interruption in the supply of pressure medium owing to the change, resulting therefrom, of the pressure values, so that the pressure medium so far stored may flow to the suction connection and cause an abrupt build up of gage pressure in the suction space. Such gage pressure pulse can in cooperation with materials handling equipment represent a disengagement pulse, which results in a more or less sudden release of an object which so far has been held.

Further advantageous developments of the invention are defined in the dependent claims.

It is convenient for the inlet connection and the suction connection to be so placed on the inlet and, respectively, suction side that their longitudinal axes coincide and lie on the said imaginary connecting line.

The space saving arrangement alongside each other of a plurality of vacuum producing devices is favored, if the housing has an elongated configuration, the inlet side and the suction side being constituted by the two end sides of the housing and the outlet side being constituted by a longitudinal side, which is aligned in the sideways direction, of the housing. It is preferred for the imaginary connecting line to coincide with the longitudinal axis of the housing or to be at least parallel to it.

It is furthermore advantageous, if the suction nozzle means and the gage pressure pulse means are arranged alongside each other so that their longitudinal sides are parallel to each other. Their overall lengths will then conveniently be at least substantially the same and they will be more particularly at the same level as related to the longitudinal direction of the housing.

The installation of the suction nozzle means and of the gage pressure pulse means is particularly simple, if the respective components are accommodated in two sockets of the housing, said sockets being arranged longitudinally alongside one another. It is possible for one or both means to be in the form of cartridge-like components, which preferably may be inserted through a terminal opening into the respective socket in the housing.

For connection with fluid ducts leading to other equipment the inlet connection or the outlet is more particularly provided with plug connection means rendering possible the connection of fluid ducts for assembly simply by inserting plugs.

Dependent on the particular application different periods may be required for blowing air into a suction space at the desired gage pressure. In order to be able to influence such blow-in period, an adjustable choke may be provided on the connection between the second valve opening of the switching valve and the suction connection, such choke being able to be set as regards the choke intensity produced.

In keeping with a preferred, compact and appropriate form of the gage pressure pulse means the moving valve member is located between the mutually opposite valve openings, the two valve openings being constituted by the bore of a tube body and being connected by way of the tube body with the suction connection and the pressure plenum being formed by an annular space surrounding the tube body. The result is then an extremely space saving and compact combination between the switching valve and the pressure plenum.

In this connection it is particularly advantageous to have a bell- or pot-like configuration of the valve member having an uninterrupted floor and a surrounding side wall forming an elastically flexible sealing lip, the floor serving as a closure member for the second valve opening and the sealing lip being biased toward the inner face of a transition space connecting the first valve opening with the pressure plenum and extending toward the pressure plenum so that it is able to be bent over inward by the pressure medium flowing in by way of the first valve opening and subject to the operational pressure and filling of the pressure plenum may take place by flow past the valve member.

BRIEF DESCRIPTION OF THE DRAWINGS

In the following the invention will be described with reference to the accompanying drawings.

DETAILED DESCRIPTION OF THE PREFERRED EMBODIMENTS

Figure 1:
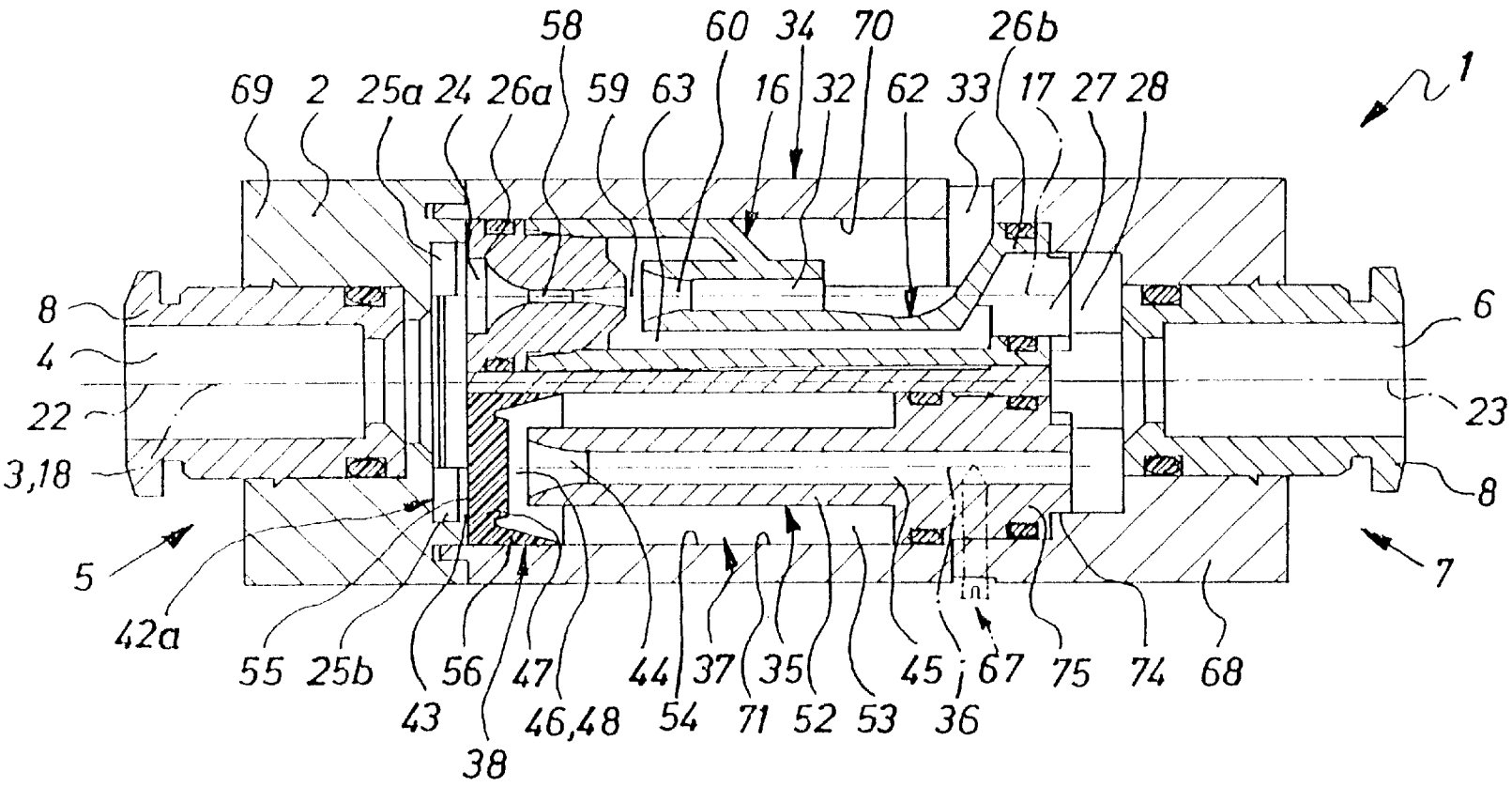
FIG. 1 shows a preferred embodiment of the vacuum producing device of the invention in a longitudinal section.

The vacuum producing device 1 illustrated in the drawings comprises an elongated housing 2 with a preferably rectangular block-like shape. The cross sectional shape of the working example is rectangular, the plane of section appearing from FIG. 1 extending in parallelism to the side faces of large area of the housing 2. As an alternative to this a round cross sectional form would be possible with a housing having an externally cylindrical housing 2.

The longitudinal axis of the housing 2 is indicated at 3 in chained lines.

On one of the axially facing end sides of the housing 2 an inlet connection 4 is provided, for which reason the respective end side is termed an inlet side 5. The axially opposite end side of the housing 2 is provided with a suction connection 6 and hence termed the suction side 7.

Each of the two connections 4 and 6 is provided with a plug connection means 8, which in either case render possible a fluid-tight and preferably detachable connection of a first and, respectively, second fluid duct 12 and 13 leading to other equipment. By way of the first fluid duct 12 a connection is possible of the inlet connection 4 with a pressure medium source P, in the case of which it will particularly be a compressed air source. The second fluid duct 13 renders possible the connection of the suction connection 6 with a suction space, i.e. a space to be evacuated, 14. The latter is in the working embodiment located in the interior of a gripping means 15 of a suction cup or sucker of a vacuum materials handling suction gripping means. The suction gripping means 15 is moved up to the object to be handled with its open side to the fore, following which the space 14 delimited on the one hand by the gripping means 15 and on the other hand by the respective object may be evacuated in order to permit holding of the object on the suction gripping means 15 owing to the negative pressure of the vacuum producing means 1. The object may for example be lifted by suitable positioning of the suction gripping means 15, and be transported and put down again. For release of the object the vacuum in the previously evacuated space 14 is cut by the admission of air.

The suction effect necessary for evacuation the suction space 14 is produced in a suction nozzle means 16 integrated in the housing 2. As shown in FIG. 1 it has an elongated configuration and is so aligned that its longitudinal axis 17 extends in the same direction as an imaginary connection line 18 linearly connecting the inlet connection 4 with the suction connection 6. In the working embodiment the connection line coincides with the longitudinal axis 3 of the housing 2, such axis 3 at the same time including the longitudinal axes 22 and 23 of the 4 inlet connection 4 and of the suction connection 6. The latter also define the assembly direction of the fluid lines 12 and 13 to be connected and furthermore the flow direction of the pressure medium flowing through the respective connection.

The suction nozzle means 16 comprises an inflow opening 24 directed in the same direction as the inlet connection 4, such opening 24 being constantly connected with the inlet connection 4 by way of an inflow duct 25*a*, which extends in the interior of the housing 2. The inflow opening 24 is located at the front end region 26*a* of the suction nozzle device 16. The suction nozzle device 16 furthermore comprises a suction opening 27 provided on the axially opposite, rear end region 26*b*, such suction opening having the same alignment as the suction connection 6. By way of a suction duct 28, which extends in the housing 2, the suction connection 6 is connected with the suction connection 6.

Finally the suction nozzle means 16 has an outflow opening 32, which is connected with an outlet 33 of the housing 2, such outlet opening at an outer face of the housing 2 and thus leading into the atmosphere. The corresponding outlet side 34 of the housing 2 extends athwart and preferably at a right angle to the imaginary connecting line 18 and also extends athwart the longitudinal axis 17 of the suction nozzle means 16. In the working embodiment illustrated it is constituted by a longitudinal side of the housing 2, such longitudinal side extending between the two end sides.

In its interior the housing 2 also longitudinally accommodates, alongside the suction nozzle means 16, a gage pressure pulse producing means 35 with the same alignment and also possessing an elongated shape. It renders possible the generation as needed of a fluid gage pressure pulse for the suction space 14.

As will appear from FIG. 1, the overall length of the gage pressure pulse means 35 is best identical to that of the suction nozzle means 16. As related to the longitudinal axis 3 the two means 16 and 35 are furthermore at the same level. Moreover, the longitudinal axis 36 of the gage pressure pulse means 35 preferably extends in parallelism to the longitudinal axis 17 of the suction nozzle means 16.

The gage pressure pulse means 35 comprises a switching valve 38 combined with a pressure holding plenum 37. A first valve opening 43, which is provided at the front end region 42*a* (facing the inlet side 5) of the gage pressure pulse means 35, is connected by way of a second inflow duct 25*b* with the inlet connection 4. For this purpose the two inflow ducts 25*a* and 25*b* may at least partially coincide with each other.

A second valve opening 44, placed opposite to the first valve opening 43 in the direction of the longitudinal axis 36 at a distance, of the switching valve 38 is connected by way of a pulse duct 45, also arranged in the interior of the housing 2, with the suction connection 6. The pulse duct 45 and the suction duct 28 can be at least partially formed as well by a common fluid duct.

Between the two valve openings 43 and 44 there is an intermediate space termed the transition space 46, wherein the valve member 47 of the switching valve 38 is located. This valve moves between an open position clear of the second valve opening 44 and a closed position sealing off the second valve opening 44. The open position of the valve member 47 is indicated in FIG. 1 and, in full lines, in FIG. 3 as well. The closed position may be gathered from FIG. 2 and as indicated in chained lines in FIG. 3. The direction of motion of the valve member 47 coincides with the alignment of the longitudinal axis 36.

A third valve opening 48 of the switching valve 38 is connected with the pressure plenum 37 integrated in the housing 2. In the working embodiment the third valve opening 48 is constituted by the transition space 46.

In the case of this particularly compact working embodiment the second valve opening 44 is constituted by the end aperture or bore of a tube body 52 extending in parallelism to the imaginary connecting line 18, the bore of such tube body being part of the pulse duct 45, around which an annular space 53 extends, which constitutes the pressure plenum 37. The transition space 46 here directly adjoins the annular space 53. The delimiting faces of the annular space 53 and the transition space 46, which both have the reference numeral 54, preferably merge directly with one another.

Figure 2:
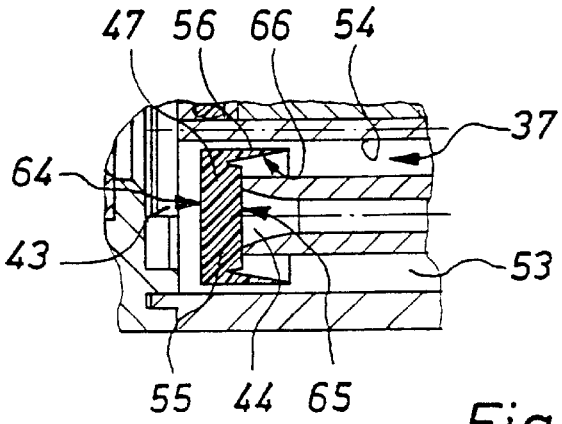
FIG. 2 is a sectional view of the vacuum producing device of FIG. 1 with the valve member of the switching valve in another switching position.

The valve member 47, which is preferably employed, possesses an integrated check valve function. As shown in FIGS. 1 and 2 it has a pot-like structure with a floor 55 extending at a right angle to the longitudinal axis 36 and a suction gripping means peripheral side wall extending away from the edge of the floor toward the pressure plenum 37, such side wall being constituted by a radially elastically flexible sealing lip 56. The sealing lip 56 engages the associated delimiting face 54 in the home position as indicated in FIG. 1, it being convenient for there to be a certain radial bias even without any fluid pressure acting.

In the following an account will be given of a preferred manner of operation of the vacuum producing device.

After the suction space 14 has been closed all the way round by the application of the suction gripping means 15 to an object to be handled, admission occurs of a pressure medium through the inlet connection 4, such medium being at the operating pressure. The admission may be caused by a control valve 57 depicted in chained lines in FIG. 3, such valve 57 being on the connection between the pressure medium source and the inlet connection 4. As an example a control valve in the form of a 3/2 way valve is illustrated at 57, which has two possible switching positions, it either opening up the connection between the pressure medium source P and the inlet connection 4 or causing an interruption of such connection with the simultaneous production of a connection between the inlet connection 4 and the atmosphere R. As an alternative a simpler 2/2 way valve would be possible for selective opening up or closing the connection without simultaneous venting.

Thus when by suitable activation—this being manual or electrical dependent on the particular design—of the control valve 57 compressed air will flow by way of the inlet connection 4 into the housing 2, same will flow in parallelism both to the inflow opening 24 of the suction nozzle means 16 and also to the first valve opening 43 of the gage pressure pulse means 35 connected in parallel to the suction nozzle means 35.

The pressure medium will firstly flow through the suction nozzle means 16, it once passing through a jet nozzle duct 58 wherein it is accelerated to an ultrasonic speed in order to then enter a receiving duct 60 after spanning an intermediate space 59, such duct leading 60 to the outlet opening 32, whence the pressure medium flows by way of the outlet 33 into the atmosphere.

The flow direction of the pressure medium within the suction nozzle means 16 runs approximately parallel to the imaginary connection line 18 as far as the outflow opening 32. Following the outflow opening 32 the pressure medium is redirected to the side by a guide wall 62 of the suction nozzle means 16 so that it lastly emerges in a direction athwart the line 18 to move away from the housing 2.

Together with the receiving nozzle duct 60 the jet nozzle duct 58 constitutes an ejector means responsible for a draw-off effect in the intermediate space 59 owing to the passage of the pressure medium therethrough. Since the intermediate space 59 communicates by way of an internal connection duct 63 in the suction nozzle means 16 with the suction opening 27, there is accordingly aspiration from the suction space 14, wherein consequently an ever increasing degree of vacuum becomes established.

The internal connection duct 63 is designed to extend past the receiving jet duct 60, something opening up a simple possibility of providing the inflow opening 24 and the suction opening 27 on mutually opposite end regions 26*a* and 26*b* of the suction nozzle means 16.

The injected pressure medium passing through the first valve opening 43 plays upon a first impingement face 64 of the valve member 47, such impingement face being constituted by the floor 55 and facing away from the both the second valve opening 44 and also from the pressure plenum 37. The valve member 47 is thus shifted into the closed position depicted in FIG. 2, it now shutting off the second valve opening 44. Simultaneously the pressure medium causes bending of the sealing lip 56 radially inward so that same, see FIG. 2, is moved clear of the associated delimiting face 54 and the pressure medium, moving past the outer periphery of the valve member 47, is able to flow in the annular space 53 of the pressure plenum 37. The pressure plenum 37 is accordingly filled with pressure medium until a there is pressure equal to the actuating pressure. The valve member 47 then dwells in the closed position.

If at a predetermined time the gage pressure obtaining in the space 14 is to be cut, it is only necessary to switch over the control valve 57 so that the inlet connection 4 is vented. In the absence of pressure medium flowing the suction effect of the suction nozzle means 16 will be interrupted. Simultaneously the valve member 47 will be shifted owing to the changed pressure relationships into the open position depicted in FIG. 1, it then ceasing to interrupt the connection between the second valve opening 44 and the pressure plenum 37. The shifting into the open position is effected because the force acting in the closed position is less than the force acting in the opening direction. The force acting in the closing direction is set by the gage pressure acting on the first impingement face 64 and furthermore by the vacuum or negative pressure, which by way of the second valve opening 44 acts on the second impingement face 65 (covering said opening 44) of the valve member 47. The force acting in the opening direction is set by the annular third impingement face or area 66, facing the annular space 53, of the valve member 47 in conjunction with the gage pressure obtaining in the annular space 53.

Flow of pressure medium out of the pressure plenum 37 to the inlet connection 4 is prevented by the check valve function of the sealing lip 56, which is thrust by the pressure differential against the associated delimiting face 54.

A comparable gage pressure pulse is created, when a control 57 is utilized without an venting function. The pressure drop at the first impingement face 64 then results exclusively from the connection of the first valve opening 43 with the outlet 33 (open to the atmosphere) by way of the suction nozzle means 16.

As compared with a vacuum producing device 1 without a gage pressure pulse means 35, there is a substantially more rapid pressure build-up in the suction space so that a previously suction held or "gripped" object is released substantially more rapidly. The gage pressure pulse can consequently be termed a release pulse as well.

Figure 3:
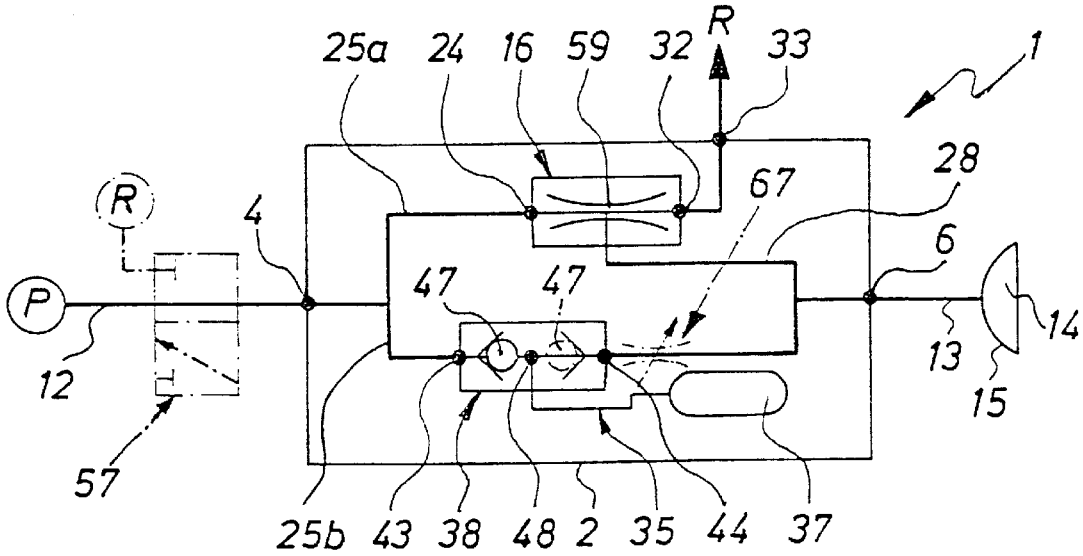
FIG. 3 is a circuit diagram of the vacuum producing device of FIGS. 1 and 2.

In case of need a choke means 67, as depicted in FIGS. 1 and 3, may be placed on the connection between the second valve opening 44 and the suction connection 6, such choke means 67 providing a means for adjustably setting the choking intensity produced in order in this manner to adapt the intensity of the gage pressure pulse or, respectively, the rate of pressure build-up in the previously evacuated suction space 14.

The vacuum producing device 1 of the working example possesses a particularly advantageous housing structure. The housing 2 is transversely split at a right angle to the longitudinal axis 3 and possesses a principal part 68 and a cover part 69 permanently and sealingly attached thereto, for example by ultrasonic welding. The two means 16 and 35 are completely accommodated in the principal part 68, which has two mutually parallel sockets 70 and 71, which are open toward the cover part 69 and are already arranged in the components of the suction nozzle means 16 and of the gage pressure pulse means 35 prior to mounting the cover part 69.

The suction nozzle means 16 possesses a cartridge-like structure and is put in place as a unit in the associated socket 70. In the installed state the outflow opening 32 communicates by way of a part of the socket with the outlet 33, which in this case is constituted by a recess extending partly through the surrounding peripheral wall of the socket 70. The gage pressure pulse means 35 is so designed that the delimiting faces 54 are directly constituted by the surrounding face of the associated socket 71. The tube body 72 a part of an insert 74, whose holding section 75 (having the same diameter as the socket 71) is inserted in the respective socket 71, from which the tube body 52 extends toward the inlet side 5. In this case the tube body 52 is made somewhat shorter than the socket 71 so that between the end of the tube body and the mounted cover part 69 a clearance will remain defining the transition space 46, into which the valve member 47 is inserted.

Both the suction nozzle means 16 designed as a subassembly and also the insert 74 of the gage pressure pulse means 35 are provided peripherally with seals in order to ensure the necessary sealing effect between them and the housing 2.

What is claimed is:

1. A vacuum producing device comprising:

a housing, having an inlet side including an inlet connection for supplying a fluid pressure medium, the housing having a suction side opposite to the inlet side including a suction connection which is connectable with a suction space to be evacuated;

an elongated suction nozzle arranged in the housing and in the same direction as an imaginary linear connecting line running between the inlet connection and the suction connection, the suction nozzle including an inflow opening, which is aligned like the inlet connection, the inflow opening being connected with the inlet connection and a suction opening of the suction nozzle being connected with the suction connection, and an outflow opening of the suction nozzle being connected with an outlet, the outlet being located on an outlet side of the housing aligned athwart the imaginary connecting line and also athwart a longitudinal extent of the suction nozzle; and a gage pressure pulse means for producing a fluid gage pressure pulse for the suction space, the gage pressure pulse means arranged in the housing alongside and adjacent to the suction nozzle and having the same alignment as the suction nozzle the gage pressure pulse means having a switching valve combined with a pressure plenum, said valve having a first valve opening connected with the inlet connection and a second valve opening connected with the suction connection, said valve having a valve member being arranged to be so operated in a manner dependent on a pressure differential applied to it that the pressure plenum is connected either with the first or with the second valve opening and for the passage of fluid.

2. The vacuum producing device as set forth in claim 1, characterized in that a longitudinal axes of the inlet connection and of the suction connection coincide with each other.

3. The vacuum producing device as set forth in claim 1, characterized in that the housing possesses an elongated configuration, the inlet side and the suction side being constituted by the two end sides of the housing and the outlet side being constituted by a laterally aligned longitudinal side of the housing.

4. The vacuum producing device as set forth in claim 1, characterized in that the imaginary connecting line runs parallel to the a longitudinal axis of the housing or coincides with same.

5. The vacuum producing device as set forth in claim 1, characterized in that the suction opening is arranged on an end side of the housing, which is opposite to the inflow opening, of the suction nozzle means and has the same alignment as the suction connection.

6. The vacuum producing device as set forth in claim 1, characterized in that the suction nozzle and the gage pressure pulse means are arranged so that longitudinal axes thereof are alongside each other and are preferably at the same axial level.

7. The vacuum producing device as set forth in claim 1, characterized in that the overall lengths of the suction nozzle and of the gage pressure pulse means are at least substantially the same.

8. The vacuum producing device as set forth in claim 1, characterized in that the housing has two sockets arranged alongside each other, in one of which the suction nozzle is located and in the other the gage pressure pulse means is located.

9. The vacuum producing device as set forth in claim 1, characterized in that the suction nozzle and/or the gage pressure pulse means are in the form of cartridge-like assemblies.

10. The vacuum producing device as set forth in claim 1, characterized in that the inlet connection and/or the suction connection respectively possess a plug connection means for a fluid duct to be connected.

11. The vacuum producing device as set forth in claim 1, characterized in that a choke is placed on a connection between the second valve opening of the switching valve and the suction connection, the choke being able to be adjusted as regards the choking intensity.

12. The vacuum producing device as set forth in claim 1, including a control valve for selective interruption or clearance of a fluid connection between the inlet connection and a pressure medium source supplying pressure medium necessary for the operation of the device.

13. The vacuum producing device as set forth in claim 12, characterized in that the control valve is in the form of a 2/2 way valve or 3/2 way valve.

14. The vacuum producing device as set forth in claim 1, characterized in that the direction of motion of the valve member is the same as the direction of the imaginary connecting line.

15. The vacuum producing device as set forth in claim 1, characterized in that the two valve openings are aligned with the longitudinal extent of the gage pressure pulse means.

16. The vacuum producing device as set forth in claim 1, further including a tube body having a base, and wherein the valve member of the gage pressure pulse means is located in a moving manner between the mutually opposite first and second valve openings, the second valve opening being constituted by the bore of the tube body, the second valve opening being connected by way of the tube body with the suction connection, and the pressure plenum being formed by an annular space surrounding the tube body.

17. The vacuum producing device as set forth in claim 16, wherein the valve member has a bell- or pot-like configuration the valve member has an uninterrupted floor and a surrounding side wall forming an elastically flexible sealing lip, the floor serving as a closure member for the second valve opening and the sealing lip extending toward the pressure plenum and being biased toward an inner face of the annular space and/or toward a transition space connecting the first valve opening with the annular space.

18. The vacuum producing device as set forth in claim 1, characterized in that the suction space is defined by a suction device of a vacuum material handling device.

* * * * *

UNITED STATES PATENT AND TRADEMARK OFFICE

CERTIFICATE OF CORRECTION

PATENT NO. : 6,729,852 B2
DATED : July 7, 2004
INVENTOR(S) : Schnatterer

It is certified that error appears in the above-identified patent and that said Letters Patent is hereby corrected as shown below:

Column 4,
Line 40, now reads "of the 4 inlet connection 4 and…", and should read -- of the inlet connection 4 and… --.

Column 8,
Line 66, now reads "of the suction nozzle means and has…", and should read -- of the suction nozzle and has… --.

Signed and Sealed this

Tenth Day of August, 2004

JON W. DUDAS
*Acting Director of the United States Patent and Trademark Office*